US007959348B2

(12) United States Patent
Hogan

(10) Patent No.: US 7,959,348 B2
(45) Date of Patent: Jun. 14, 2011

(54) AGITATING CANISTER FOR VISCOUS FLUIDS DISPENSED FROM MULTIPLE FLUID DISPENSERS

(75) Inventor: Tim Patrick Hogan, Round Lake Beach, IL (US)

(73) Assignee: Fluid Management, Inc., Wheeling, IL (US)

( * ) Notice: Subject to any disclaimer, the term of this patent is extended or adjusted under 35 U.S.C. 154(b) by 1046 days.

(21) Appl. No.: 11/686,273

(22) Filed: Mar. 14, 2007

(65) Prior Publication Data

US 2008/0225637 A1 Sep. 18, 2008

(51) Int. Cl.
*B01F 15/02* (2006.01)
*B01F 7/16* (2006.01)

(52) U.S. Cl. ..... 366/196

(58) Field of Classification Search ..... 366/194, 366/195, 196; 99/513, 503
See application file for complete search history.

(56) References Cited

U.S. PATENT DOCUMENTS 1,969,006 A * 8/1934 Herman ..... 99/502
2,247,948 A * 7/1941 Johnson ..... 99/505
2,533,811 A * 12/1950 Jepson ..... 99/501
4,240,338 A * 12/1980 McClean ..... 99/501
4,378,730 A * 4/1983 Coggiola ..... 99/501
5,445,069 A * 8/1995 Lucas et al. ..... 99/508
6,273,298 B1 8/2001 Post
7,028,606 B2 * 4/2006 Basora ..... 99/504
2008/0225637 A1 * 9/2008 Hogan ..... 366/317
* cited by examiner

*Primary Examiner* — Tony G Soohoo
(74) *Attorney, Agent, or Firm* — Miller, Matthias & Hull LLP

(57) ABSTRACT

An improved canister assembly for a multi-fluid dispenser is shown and described. The canister assembly comprises an annular outer shell with an outer cylindrical wall connected to a bottom which, in turn, is connected to an inner cylindrical wall that serves as a standpipe. The bottom includes an outlet connected to a pump A hollow agitator shaft slides over the inner standpipe and includes a plurality of outwardly extending blades for stirring or "agitating" the fluid. An annular screen element is disposed below the bottom end of the agitator shaft. Beneath the annular screen element is a lower agitator blade element The lower blade element and the lower end of the agitator shaft are snap-fitted together with the annular screen element sandwiched therebetween. The screen element includes a cylindrical shell with the annular screen disposed upwards from the lower end of the cylindrical shell so that the screen is spaced above the bottom wall and to make room for the lower blade element. Blades disposed on the lower end of the agitator shaft scrape or brush a top surface of the annular screen and the blades of the lower blade element scrape or brush a bottom surface of the annular screen. Sufficient space is provided between annular screen and the bottom outlet to prevent clogging. A deflector cap is provided for a top end of the hollow agitator shaft to prevent spillage of fluid material through the agitator shaft when the canister is refilled. The deflector cap can also be snap-fitted to the agitator shaft. A centralizer is also provided for holding the agitator shaft in place during refilling of the canister.

19 Claims, 7 Drawing Sheets

FIG. 7A
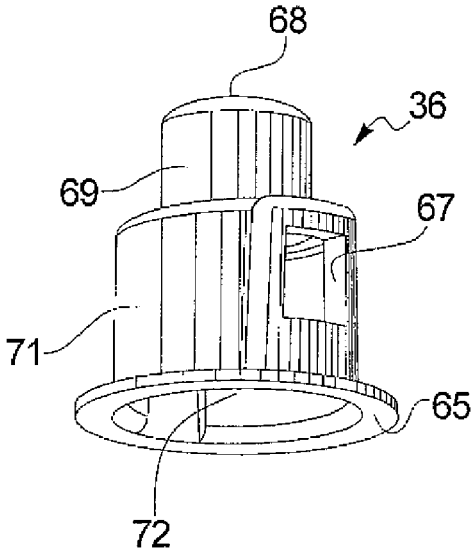
FIG. 7B
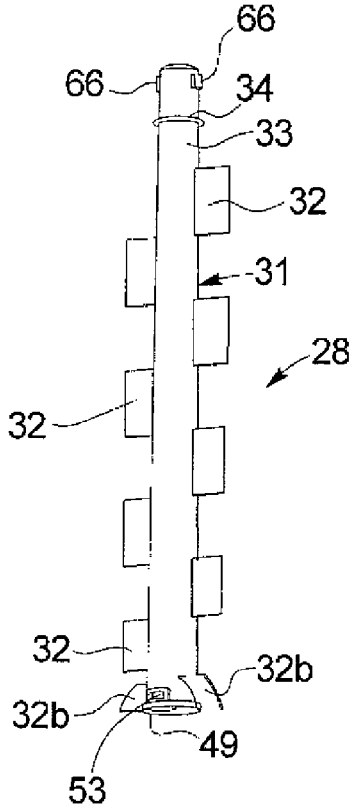
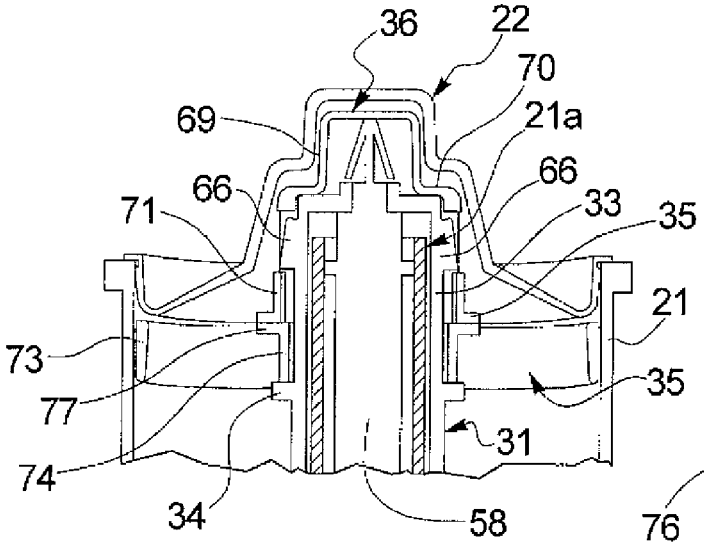
FIG. 7C
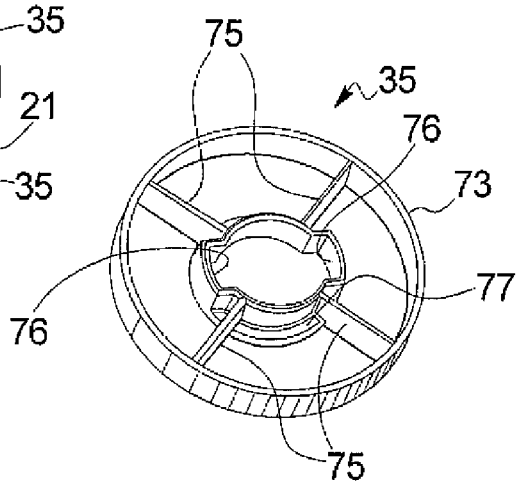
FIG. 7D

AGITATING CANISTER FOR VISCOUS FLUIDS DISPENSED FROM MULTIPLE FLUID DISPENSERS

BACKGROUND

1. Technical Field

This disclosure is directed toward multiple fluid dispensing systems. More specifically, this disclosure is directed toward canisters used for storing fluids yet to be dispensed in multiple fluid dispensing systems Still more specifically, this disclosure is directed toward canisters for housing viscous fluids prone to settling and stratification and which are therefore in need of an internal agitation mechanism. Disclosed herein is the following: an improved scraping/agitation blade design; and improved bottom screen/filter design; an improved blade configuration for scraping above and below the screen/filter; a snap-fit construction of the agitation assembly; an upper cap for preventing spillage during filling of the canister; and a centering guide for holding the agitator assembly in place during filling of the canister.

2. Description of the Related Art

Systems for dispensing a plurality of different fluids into a container have been known and used for many years. For example, systems for dispensing paint base materials and colorants into a paint container are known These paint systems may use twenty or more different colorants to formulate a paint mixture. Each colorant is contained in a separate canister or package and may include its own dispensing pump, e.g., see U.S. Pat. No. 6,273,298, which is commonly assigned with the present application. The colorants and the respective pumps may be disposed on a turntable or along one or more horizontal rows. In a turntable system, the turntable is rotated so that the colorant to be dispensed is moved to a position above the container being filled. In designs using one or more horizontal rows, the container may be moved laterally to the appropriate colorant/pump. Systems for dispensing large varieties of different fluids are not limited to paints, but also include systems for dispensing pharmaceutical products, hair dye formulas, cosmetics or all kinds, nail polish, etc. Smaller systems for use in preparing products at a point of sale may use a stationary manifold through which a plurality of nozzles extend. Each fluid to be dispensed is then pumped through its individual nozzle. Depending upon the size of the container and the quantity of the fluids to be dispensed, manifolds must be designed in a space efficient manner so that a single manifold can accommodate twenty or more different nozzles The nozzles are connected to the various ingredients by flexible hoses and the ingredients are contained in stationary canisters or containers.

A variety of different types of canisters exists for storing fluids prior to dispensing. For viscous fluids like paint colorants and certain cosmetics ingredients, the canister design may utilize a screen to filter the viscous fluid in combination with rotating agitation blades to periodically mix the viscous fluid The filter and agitation blades are necessary as viscous fluids, particularly colorants, are prone to settling and stratification. Generally, most viscous fluids stored for prolonged periods in canisters that are part of a fluid dispensing system will require some sort of periodic agitation/stirring/screening.

One problem associated with such existing canister designs is the placement of the screen/filter at the bottom of the canister. Specifically, the spacing between the screen and the bottom outlet tends to be too small resulting in a restrictive flow through the screen and a limitation on the effective screen/filter surface area. Further, the agitation blades typically do not do not agitate in close proximity to the screen As a result, a layer of settled or thickened fluid may accumulate on the screen, thereby restricting flow through the screen Still another problem is related to the relative and accessibility of the screen; currently employed screens/filters for agitation canisters can not be easily removed for cleaning and maintenance purposes.

Another problem associated with vertically oriented canisters equipped with an agitation blade is the hollow design of the blade. When the canisters are filled, fluid is often spilled down the center of the blade which results in fluid dripping downward through the dispensing system, which may include sensitive electronic components. In any event, such occurrences require additional cleaning and maintenance.

Another related problem is a tendency of the agitation blade to interfere with the filling of the canister. Specifically, agitation blades typically include a long shaft with radial paddles or fans. The ends of the shaft are held in place by the container top and the lower screen/outlet assembly When the container top is removed for filling, the shaft tends to wobble and interfere with the filling process, often resulting in spillage. Thus, an improved means for stabilizing the agitator during the filling process would be helpful.

SUMMARY OF THE DISCLOSURE

In satisfaction of the aforenoted needs, disclosed herein is the following: an improved scraping/agitation blade design; an improved bottom screen/filter design; an improved blade configuration for scraping above and below the screen/filter; a snap-fit construction of an agitation assembly; an upper deflector cap for preventing spillage during filling of the canister; and a centering guide for holding the agitator assembly in place during filling of the canister.

An annular screen element for a cylindrical canister having an agitator is disclosed. The screen element comprises a vertical cylindrical outer shell having an upper end and a lower end. The lower end is connected to a plurality of downwardly extending feet. An annular screen is disposed horizontally within the shell and spaced above the lower end of the cylindrical shell to maintain the annular screen at an elevated position with respect to a bottom of the canister and sufficiently above a bottom outlet. The elevated position of the annular screen also enables the placement of agitator blades above and below the screen to keep the screen clean and unclogged A deflector cap is also disclosed for preventing fluid spillage down through a cylindrical shaft when the canister is refilled. The disclosed deflector cap comprises a lower flange connected to and disposed below a lower cylindrical wall. The lower flange has a maximum outer diameter greater than that of the lower cylindrical wall. The lower cylindrical wall is connected to an upper cylindrical wall by a horizontal step. The upper cylindrical wall is connected to enclosed by a solid top. The maximum outer diameter of the lower cylindrical wall than that is greater of the upper cylindrical wall. The lower cylindrical wall comprises diametrically opposed openings therein and a pair of diametrically opposed vertical recesses extending from the lower flange to one of the openings. The openings in the recesses receive cleats disposed on an upper end of an agitator shaft for the purpose of snap-fitting the deflector cap to the agitator shaft A centralizer is also disclosed for an agitator of a cylindrical fluid canister. The purpose of the centralizer is to centralize the agitator shaft while the canister is being filled or refilled with liquid. The centralizer comprises an outer ring connected to an inner ring by a plurality of radially extending spokes. The inner ring mateably receives the agitator shaft and comprises diametrically opposed recessed areas. The lower ring further comprises a horizontal lower flange that can rest on a complimentary ring are flange disposed on the agitator shaft after the centralizer is inserted over the agitator shaft.

Canister assemblies for storing viscous fluids are also disclosed. One disclosed canister assembly comprises an annular housing comprising an outer cylindrical wall that is connected to a bottom that, in turn, is connected to an inner cylindrical wall that serves as an inner standpipe The bottom comprising an outlet opening that is connected to a pump An annular screen element is also provided that slides over the standpipe. The annular screen element comprises a cylindrical outer shell that slides inside the outer cylindrical wall of the annular shell. The vertical cylindrical outer shell of the screen element has an upper end and a lower end. The annular screen element further comprises an annular screen disposed horizontally within the vertical cylindrical outer shell and spaced above the lower end thereof. The lower end of the vertical outer cylindrical shell supports the screen element above the bottom of the annular housing and the outlet.

In a refinement, the annular screen element is fabricated from molded plastic.

In a refinement, the lower end of the vertical cylindrical outer shell of the annular screen element is connected to a downwardly extending foot that supports the lower end of the vertical cylindrical outer shell and the annular screen above the bottom in the outlet of the annular housing.

In another refinement, the canister assembly further comprises a hollow agitator shaft that slides over the standpipe above the annular screen element. The canister further comprises a lower blade element that slides over the standpipe and is positioned below the annular screen element. The lower blade element and agitator shaft are connected together with the annular screen element sandwiched therebetween.

In another refinement, the lower blade element comprises at least one radially extending blade that engages an underside of the annular screen and the agitator shaft comprises the least one radially extending blade that engages an upper surface of the annular screen.

In another refinement, the lower blade element and the agitator shaft are snap-fitted together.

In another refinement, the lower blade element and the agitator shaft are snap-fitted together.

In another refinement, an upper end of the hollow agitator shaft is connected to a deflector cap for enclosing the upper end of the hollow agitator shaft. In a further refinement of this concept, the deflector cap comprises a lower flange connected to and disposed below a lower cylindrical wall. The lower flange as a maximum outer diameter greater than that of the lower cylindrical wall. The lower cylindrical wall is connected to an upper cylindrical wall by a horizontal step. The upper cylindrical wall is connected to and enclosed by a solid top. The maximum outer diameter of the lower cylindrical wall is greater than that of the upper cylindrical wall. The lower cylindrical wall comprises diametrically opposed openings therein and a pair of diametrically opposed vertical recesses extending from the lower flange to one of the openings The agitator hollow shaft comprises a pair of diametrically opposed cleats that snap-fit into the openings of the lower cylindrical wall of the deflector cap.

BRIEF DESCRIPTION OF THE DRAWINGS

For a more completer understanding of this disclosure, reference should now be made to the embodiments illustrated in greater detail in the accompanying drawings, wherein.

FIG. 7A is a perspective view of a deflector cap;

FIG. 7B is a perspective view of an agitator shaft;

FIG. 7C is a sectional view of an upper end of the agitator shaft, deflector cap and canister; and FIG. 7D is a perspective view of a disclosed centralizer.

It should be understood that the drawings are not necessarily to scale and that the embodiments are often illustrated by graphic symbols, phantom lines, diagrammatic representations and fragmentary views. In certain instances, details have been omitted which are not necessary for an understanding of the disclosed embodiments or which render other details difficult to perceive. It should be understood, of course, that this disclosure is not limited to the particular embodiments illustrated herein.

DETAILED DESCRIPTION OF THE PRESENTLY PREFERRED EMBODIMENTS

Figure 1:
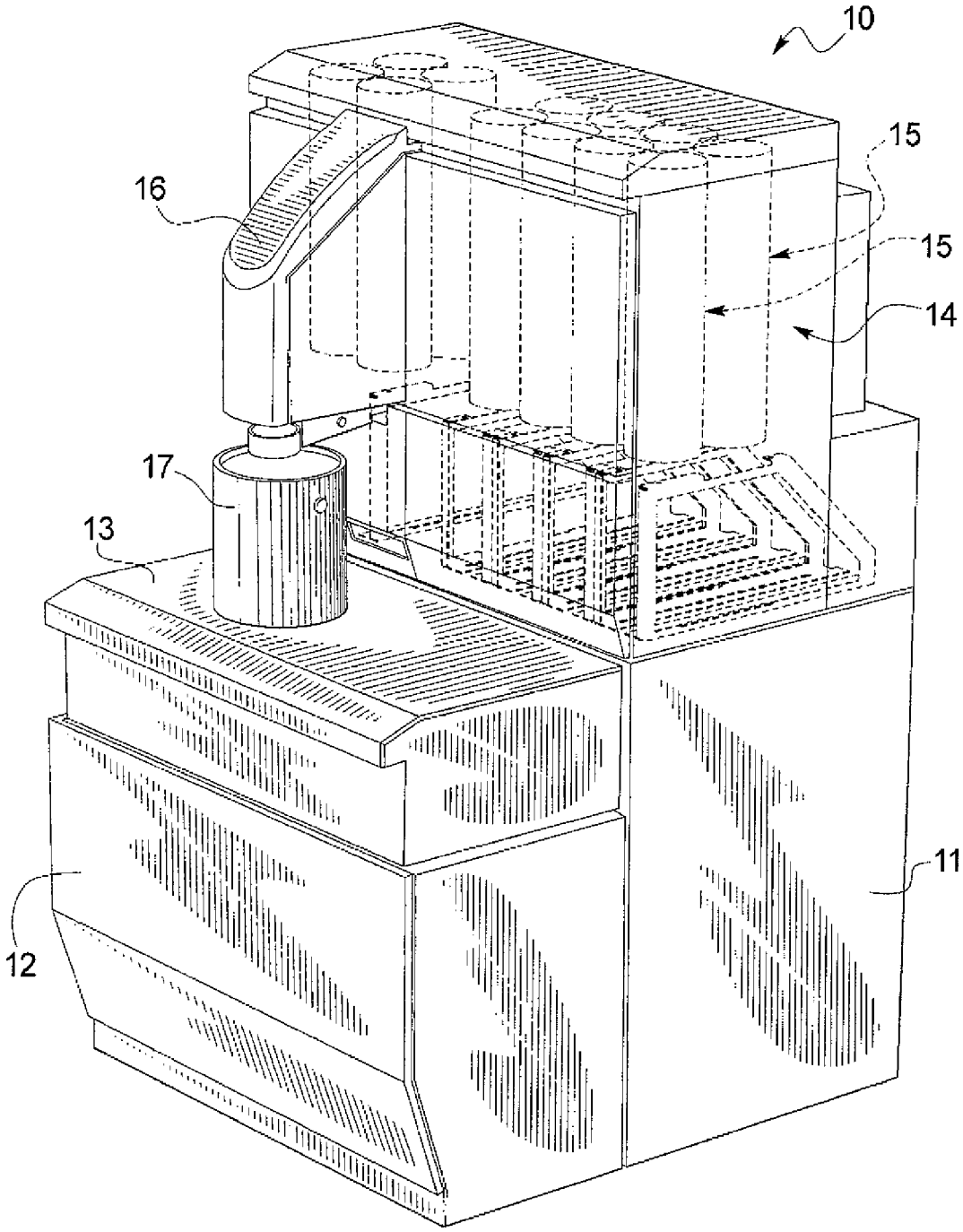
FIG. 1 is perspective view of a fluid dispensing apparatus that can utilize the improved canisters disclosed herein.
Figure 2:
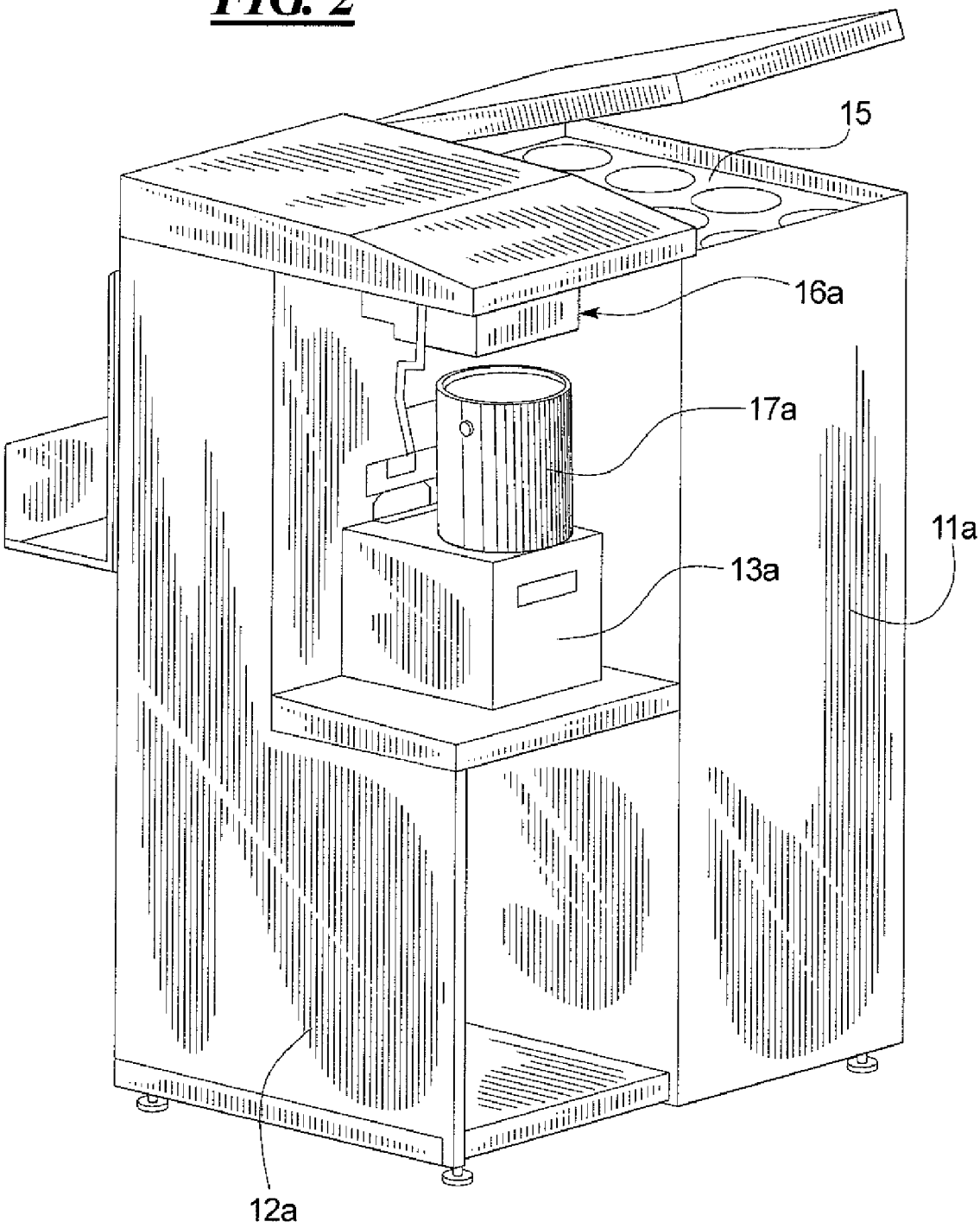
FIG. 2 is perspective view of another fluid dispensing apparatus that can utilize the improved canisters disclosed herein.

A FIGS. 1 and 2 disclose dispensing apparatuses that can utilize the improved canister designs disclosed herein. FIG. 1 discloses a dispensing apparatus 10 which includes a tear base portion/housing 11 connected to a lower front cabinet 12 which, in turn, is disposed beneath and supports an upper front cabinet shown at 13. The upper front cabinet 13 may also include a scale or weighing function (not shown). Any one of the cabinets 11 through 13 may house a controller and other electronic equipment (not shown). The cabinet 11 supports an upper rear cabinet 14 which, in turn, houses a plurality of modules which are represented by pairs of canisters shown generally at 15. It is the improved design of the canisters 15 which are the primary subject of this disclosure. FIG. 1 also illustrates a manifold module 16 through which fluid is simultaneously or sequentially dispensed into the container 17 from the fluid canisters 15. Similarly, FIG. 2 discloses a cabinet 11*a* which supports a plurality of canister's (not shown) in the canister bracket 15*a*. A cabinet 12*a* and removable support structure 13*a* supports the container 17*a* below the manifold 16*a*.

Figure 3C:
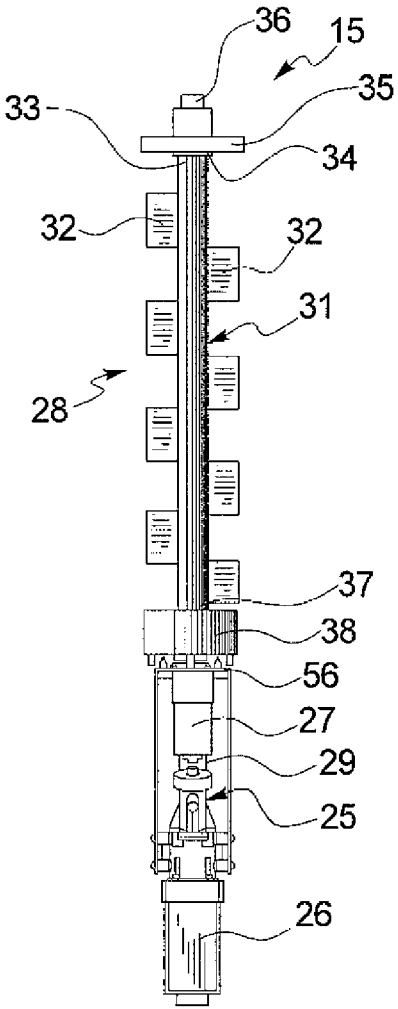
FIG. 3C is a front plan view of the disclosed fluid canister, agitation motor and fluid pump of FIGS. 3A and 3B with the outer canister shell removed.

The improved canister 15 of this disclosure is illustrated in greater detail in connection with FIGS. 3A-3C. Turning to FIG. 3A, the canister 15 includes a cylindrical shell 21 with an open top covered by a lid 22. The lid 22 includes a tab 23 to facilitate removal thereof. Below the shell 21 is a pair of brackets 24 that connect the canister 15 to a fluid pump 25. The pump motor is shown at 26 An agitation motor 27 is used to turn the agitator 28 shown in FIG. 3C.

Figure 3B:
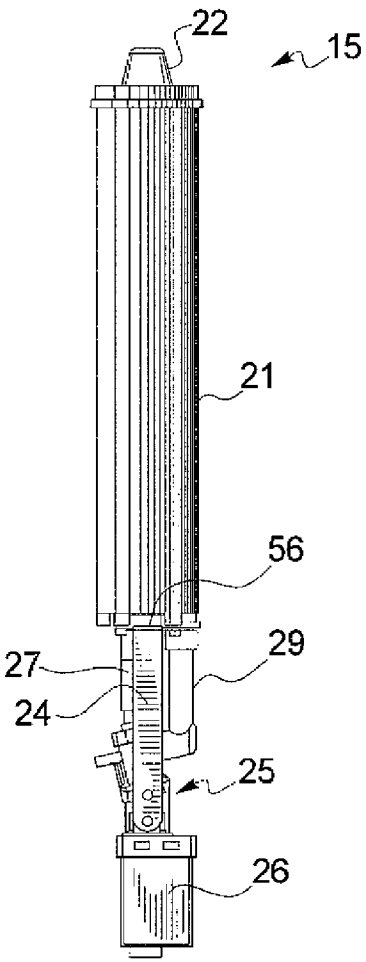
FIG. 3B is a front plan view of the disclosed fluid canister, agitation motor and fluid pump of FIG. 3A.
Figure 3A:
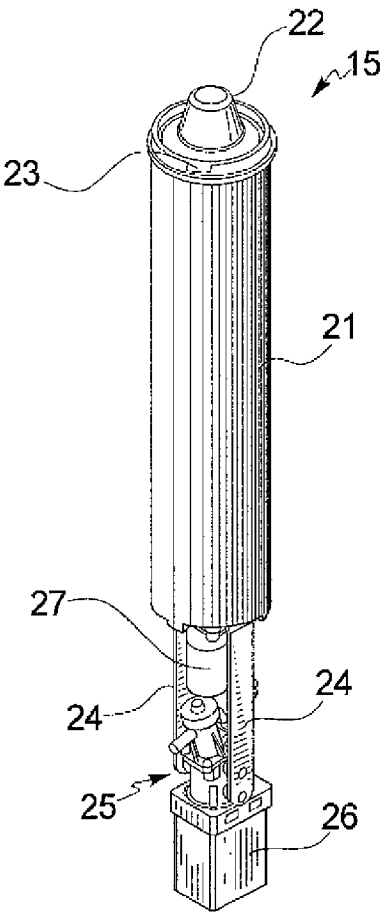
FIG. 3A is a perspective view of a disclosed fluid canister, agitation motor and fluid pump.

Turning to the FIG. 3B, communication between the shell 21 and the pump 25 is provided by the outlet line 29. In FIG. 3C, the agitator 28 comprises a shaft 31 with a plurality of radially outwardly extending blades 32 axially spaced along the shaft 31 An upper end 33 of the shaft 31 includes a ring 34 that supports the centralizer 35 that will be discussed in greater detail below in connection with FIG. 7D. The upper end 33 of the shaft 31 is also connected to a deflector cap 36 that will be discussed in greater detail below in connection with FIGS. 7A and 7C.

Figure 6A:
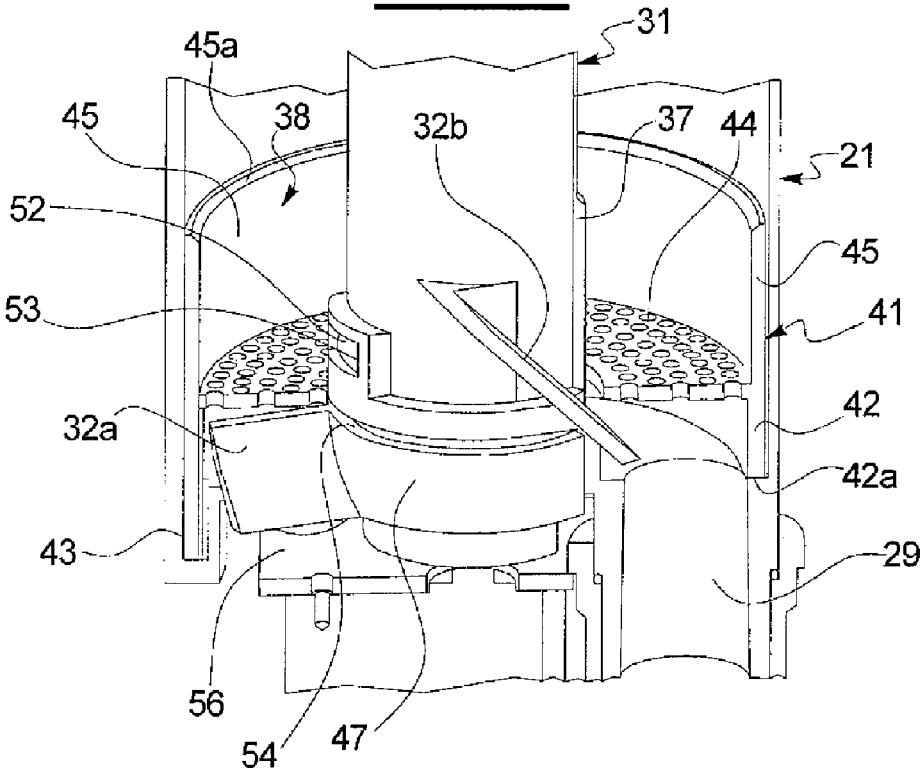
FIG. 6A is a partial sectional view illustrating the relationship between the screen of FIGS. 4A-4B, the bottom scraping blade of FIG. 5A and the agitation blade of FIG. 5B.
Figure 6B:
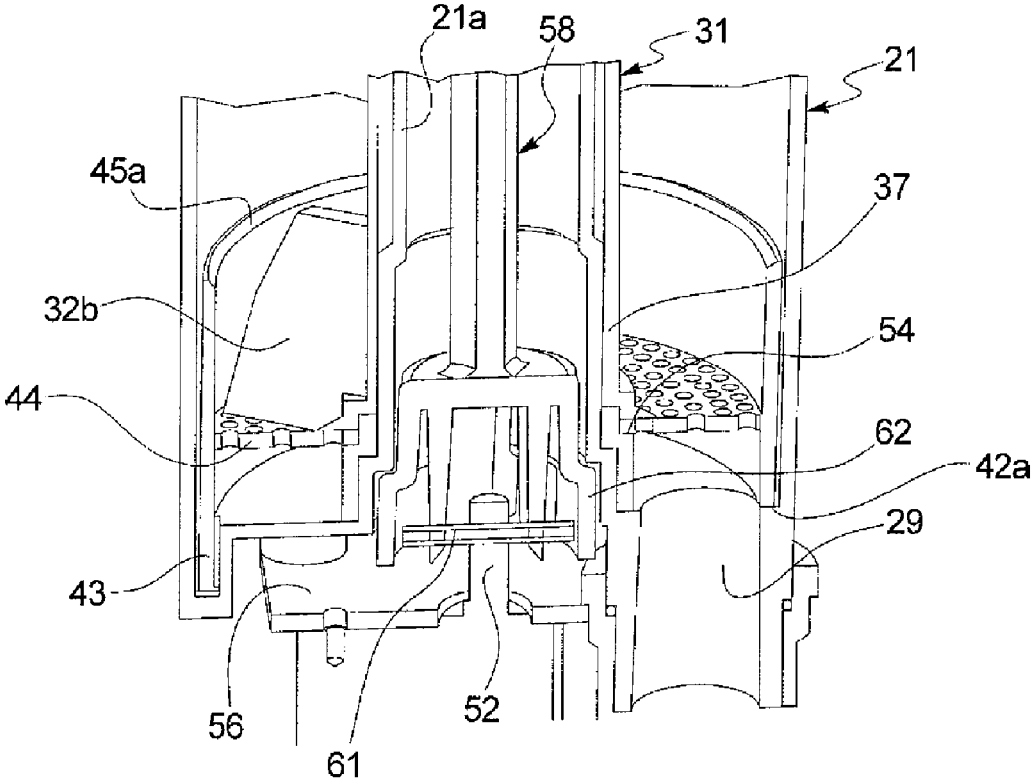
FIG. 6B is another partial sectional view illustrating the relationship between the screen of FIGS. 4A-4B, the bottom scraping blade of FIG. 5A and the agitation blade of FIG. 5B.
Figure 6C:
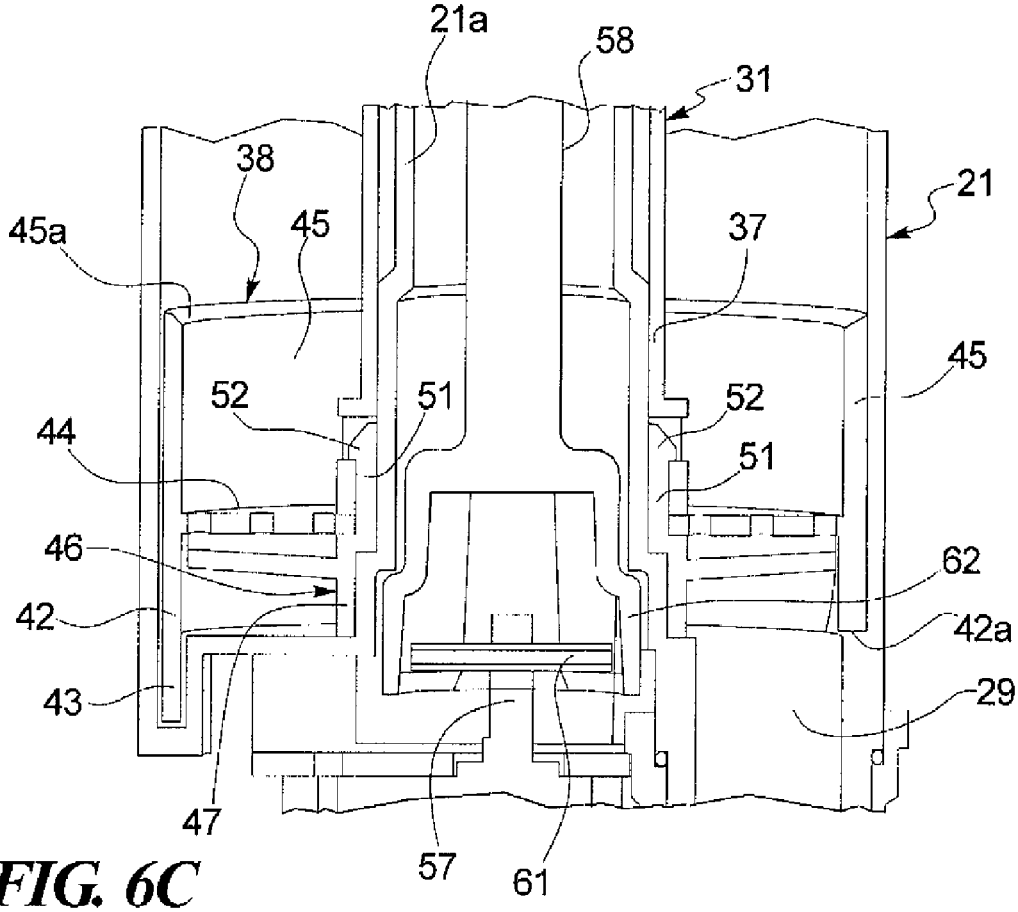
Figure 6D:
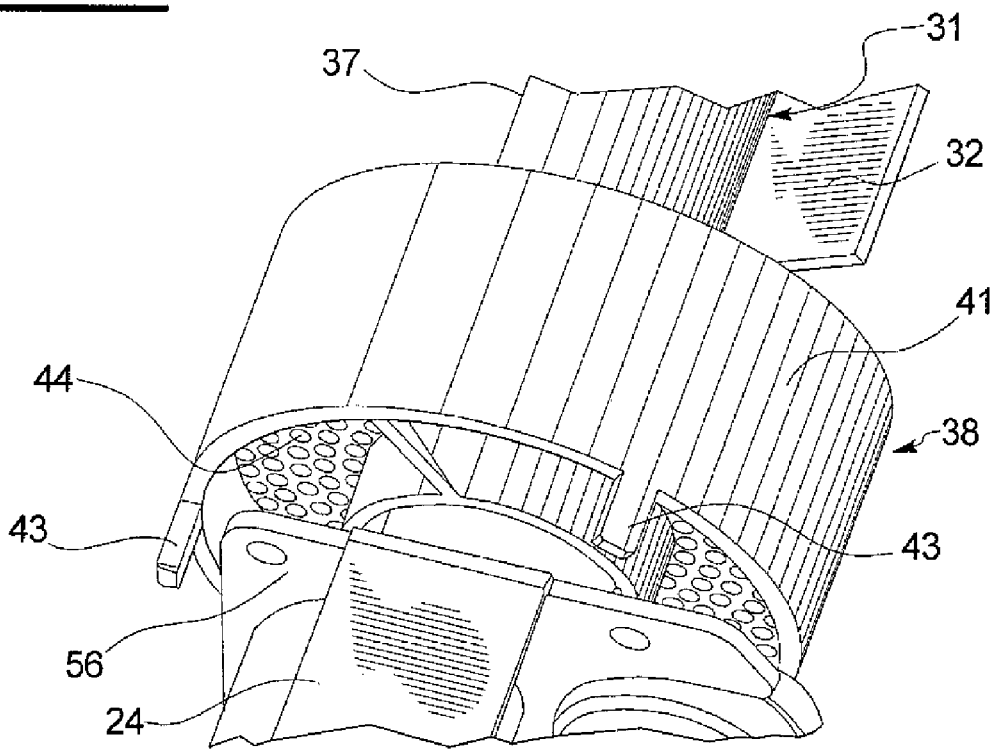

The lower end 37 of the shaft 31 passes through a screen 38 and will be discussed in greater detail below in connection with FIGS. 4A-4B and 6A-6D. The connection between the shaft 31 and the agitation motor 27 is illustrated in FIGS. 6B-6C.

Figure 4A:
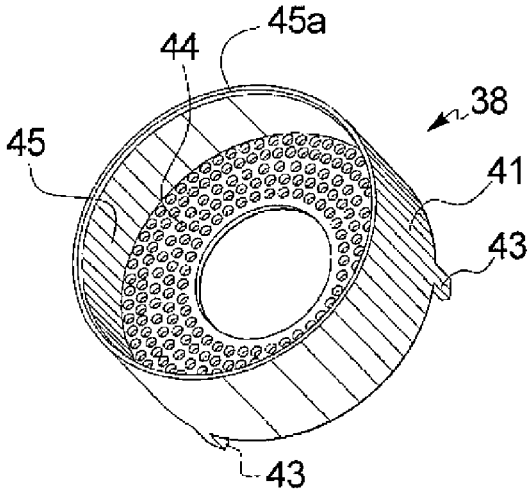
FIGS. 4A and 4B are perspective views of an improved screen design for use in the canister of FIG. 3.
Figure 4B:
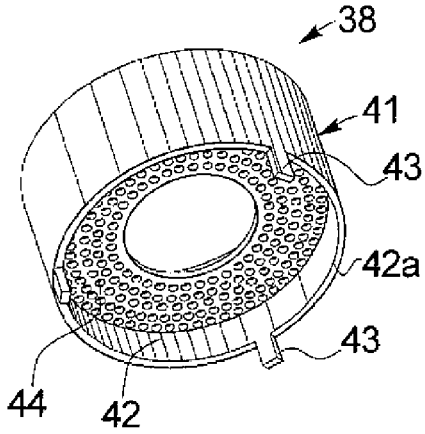

Turning to FIGS. 4A-4B, an improved screen/filter 38 is disclosed. The screen 38 serves as a filter to remix settled solids and sediment back into the fluid before the fluid passes down through the outlet 29 to the pump 25. When dispensing viscous slurries, screen filters known in the art have a tendency to clog. Further, the proximity of prior art screen filters to the bottom outlet line 29 can limit the effective surface area of the screen to the portion of the screen disposed immediately above the outlet In contrast, the screen 38 is disposed within a vertical cylindrical housing 41 that includes a lower portion 42 disposed below the screen along with supporting legs 43 that effectively elevate the filter element 44 above the outlet 29 as illustrated below in connection with FIGS. 6A-6D As seen in FIG. 6A the upper portion 45 of the housing 41 fits snugly within the canister shell 21. The lower portion 42 of the cylindrical housing 41 terminates at a lower end 42*a* and the upper portion 45 of the cylindrical housing 41 terminates at an upper end 45*a*.

Figure 5A:
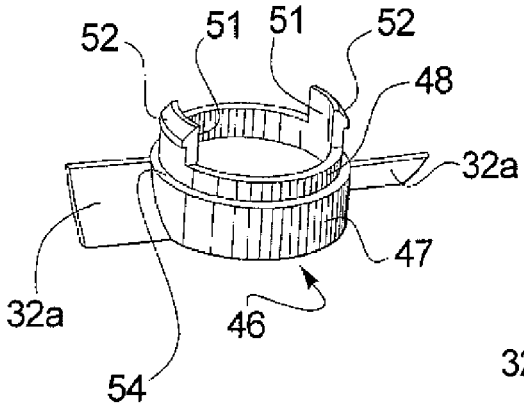
FIG. 5A is a perspective view of a bottom scraping blade that snap-fits onto a lower end of the agitation blade partially shown in FIG. 5B.
Figure 5B:
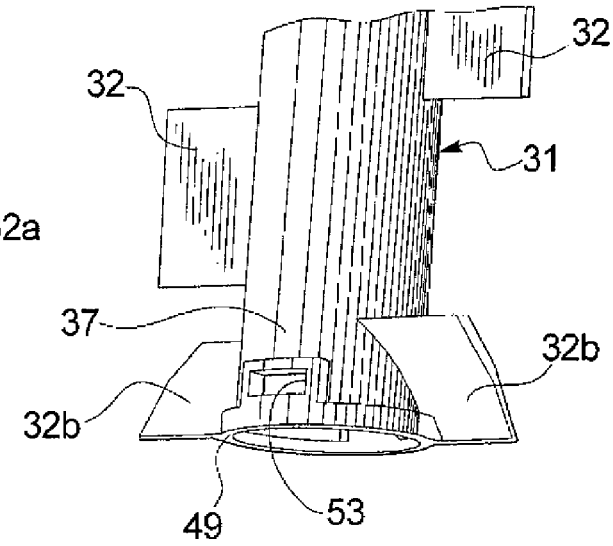
FIG. 5B is a partial perspective view of a disclosed agitation blade.

Turning to FIGS. 5A-5B, the screen 38 is attached to the lower end 37 of the shaft 31 by the snap-fit connection between the lower blade element 46 and the lower end 37 of the shaft 31 Specifically, as seen in FIG. 5A, the lower blade element 46 includes a lower cylinder 47 with a recessed upper portion 48 that fits within the lower rim 49 of the lower end of 37 of the shaft 31. A pair of upwardly protruding legs 51 also fit within the lower rim 49 of the shaft 31. The legs 51 are equipped with radially outwardly protruding tabs 52 that snap-fit into openings, only one of which is shown at 53 in FIG. 5B. The screen element 44 is sandwiched between the upward facing ledge 54 (FIG. 5A) and the lower rim 49 (FIG. 5B). The lower blades 32*a* and upper blades 32*b* scrape the bottom and top of the screen element 44 respectively.

The assembly of the lower blade element 46 onto the lower end 37 of the shaft 31 with the screen element 38 sandwiched therebetween is further illustrated in the sectional views of FIGS. 6A-6C. the product outlet is shown at 29 which is spaced sufficiently below the screen element 44 so as to permit passage of the lower blades 32*a* therebetween A bracket 56 is also shown which supports the agitation motor 27 in which is connected to the vertical brackets 24 as shown in FIGS. 3A-3C. The agitation motor shaft is shown at 57 in FIG. 6B. Still referring to FIG. 6B, the outer shell 21 also forms an inner standpipe 21*a* which fits inside of the shaft 31 A bottom panel 21*b* connects the inner standpipe 21*a* to the outer cylindrical shell 21 thereby providing the canister 15 with an annular housing that is unitary in structure with the exception of the open top 21*d* (see FIG. 7C) and the outlet opening 29 (FIGS. 6A-6C) that is formed in the bottom panel 21*b*. A coupling shaft 58 is disposed within the standpipe 21*a* that couples the motor shaft 57 to the agitator shaft 31. More specifically, as illustrated in FIG. 7C the agitator motor shaft 57 is connected to a crossbar 61 which, in turn, is coupled to the lower fork 62 of the coupling shaft 58. As the coupling shaft 58 is connected to the upper and 33 of the agitator shaft 31, the agitator motor shaft 57 can indirectly impart rotation to the agitator blades 32.

FIGS. 7A-7D illustrate the upper and 33 of the agitator shaft 31 in greater detail. Referring to FIG. 78, the upper end 33 of the shaft 31 includes the ring 34 which serves as a seat for the centralizer 35. The upper end 33 of the shaft 31 also includes a pair of opposing cleats 66 which snap-fit into the openings 67 (only one of which is shown in FIG. 7A).

The deflector cap 36 includes a lower flange that rests on the centralizer 35 (see FIG. 7C), a closed top 68 and solid sidewall structures 69, 71 with the exception of the openings 67 for the cleats 66. The lower sidewall 71 is connected to the upper side wall 69 by the horizontal step 70 (see FIG. 7C) The lower sidewall 71 is connected to the lower flange 65. The lower flange 65 has a diameter greater than the lower cylindrical wall 71 which has a greater diameter than the upper cylindrical wall 69. As seen in FIG. 7A, opposing channels 72 are provided for accommodating the cleats 66 of the agitator shaft 31. As a result, the snap-fit of the deflector cap 36 onto the upper end 33 of the shaft 31 prevents any fluid from flowing downward through the hollow shaft 31 towards the motor shaft (see FIGS. 6B-6C).

FIG. 7D discloses the centralizer 35 which fits over the upper end 33 of the shaft and rests on the ring or circumferential rib 34 as shown in FIG. 7C. The centralizer 35, in turn, serves as a seat for the lower flange 65 of the deflector cap 36. The centralizer 35 includes an outer ring 73 connected to an inner ring 74 by a plurality of spokes 75 The inner ring 74 includes opposing recesses 76 that slide past the cleats 66 disposed on the upper end 33 of the shaft 31 (FIG. 7B). The inner ring 74 also includes a flange 77 that supports the lower flange 65 of the deflector cap 36 as seen in FIG. 7C. During refilling of the canister 15, the centralizer holds the agitator 28 in place and helps to prevent spillage. The deflector cap 36 prevents spillage of material down through the shaft 31 of the agitator 28.

While only certain embodiments have been set forth, alternative embodiments and various modifications will be apparent from the above description to those skilled in the art. These and other alternatives are considered equivalents and within the spirit and scope of this disclosure.

What is claimed:

1. A canister assembly for storing viscous fluids, the canister assembly comprising:

an annular housing comprising an outer cylindrical wall, a bottom and an inner standpipe, the bottom comprising an outlet, the bottom connecting the outer cylindrical wall to the inner standpipe, an annular screen element that slides over the standpipe, the annular screen element comprising a cylindrical outer shell that slides inside the outer cylindrical wall of the annular housing, the cylindrical outer shell having an upper end and a lower end, the annular screen element further comprising an annular screen disposed horizontally within the cylindrical outer shell and spaced above the lower end thereof, the lower end of the outer cylindrical shell supporting the annular screen element above the bottom of the annular housing and the outlet, a hollow agitator shaft that slides over the standpipe above the annular screen element, the canister further comprising a lower blade element that slides over the standpipe and is positioned below the annular screen element, the lower blade element and hollow agitator shaft being connected together with the annular screen element sandwiched therebetween.

2. The canister assembly of claim 1, wherein the annular screen element is fabricated from molded plastic.

3. The canister assembly of claim 1, wherein the lower end of the cylindrical outer shell of the annular screen element is connected to a downwardly extending foot that supports the lower end of the cylindrical outer shell and the annular screen above the bottom of the annular housing and above the outlet in the bottom of the annular housing.

4. The canister assembly of claim 1 wherein the lower blade element comprises at least one radially extending blade that engages an underside of the annular screen and the agitator shaft comprises the least one radially extending blade that engages an upper surface of the annular screen.

5. The canister assembly of claim 4 wherein the lower blade element and the hollow agitator shaft are snap-fitted together.

6. The canister assembly of claim 1 wherein the lower blade element and the hollow agitator shaft are snap-fitted together.

7. The canister assembly of claim 1 wherein an upper end of the hollow agitator shaft is connected to a deflector cap for enclosing the upper end of the hollow agitator shaft.

8. The canister assembly of claim 7 wherein the deflector cap comprises a lower flange connected to and disposed below a lower cylindrical wall, the lower flange having a maximum outer diameter greater than that of the lower cylindrical wall, the lower cylindrical wall being connected to an upper cylindrical wall by a horizontal step, the upper cylindrical wall being connected to an enclosed by a solid top, the maximum outer diameter of the lower cylindrical wall being greater than that of the upper cylindrical wall, the lower cylindrical wall comprising diametrically opposed openings therein and a pair of diametrically opposed vertical recesses extending from the lower flange to one of the openings, the hollow agitator shaft comprising a pair of diametrically opposed cleats that snap-fit into the openings of the lower cylindrical wall of the deflector cap.

9. The canister assembly of claim 8 further comprising a centralizer mateably received over the hollow agitator shaft, the centralizer comprising an outer ring connected to an inner ring by a plurality of radially extending spokes, the inner ring of the centralizer comprising a pair of diametrically opposed recesses for accommodating the cleats of the hollow agitator shaft and allowing the centralizer to be slid downward on the shaft past the cleats, the hollow agitator shaft comprising a circumferential rib, the inner ring of the centralizer comprising a horizontal lower flange that engages and is supported by the circumferential rib.

10. The canister assembly of claim 1 further comprising a centralizer mateably received over the hollow agitator shaft, the centralizer comprising an outer ring connected to an inner ring by a plurality of radially extending spokes, the hollow agitator shaft comprising a circumferential rib, the inner ring of the centralizer comprising a horizontal lower flange that engages and is supported by the circumferential rib.

11. A canister assembly for storing viscous fluids, the canister assembly comprising:

an annular housing comprising an outer cylindrical wall, a bottom and an inner standpipe, the bottom comprising an outlet connected to a pump, the bottom connecting the outer cylindrical wall to the inner standpipe, an annular screen element that slides over the standpipe, the annular screen element comprising a cylindrical outer shell that slides inside the outer cylindrical wall of the annular housing, the cylindrical outer shell having an upper end and a lower end, the annular screen element further comprising an annular screen disposed horizontally within the vertical cylindrical outer shell and spaced above the lower end thereof, the lower end of the vertical outer cylindrical shell supporting the annular screen element above the bottom of the annular housing and above the outlet, a hollow agitator shaft mateably received over the standpipe and above the annular screen element, a lower blade element mateably received over the standpipe and below the annular screen element, the lower blade element and agitator shaft being connected together with the annular screen element sandwiched therebetween.

12. The canister assembly of claim 11, wherein the lower end of the vertical cylindrical outer shell of the annular screen element is connected to a downwardly extending foot that supports the lower end of the vertical cylindrical outer shell and the annular screen above the bottom of the annular housing and above the outlet in the bottom of the annular housing.

13. The canister assembly of claim 12 wherein the lower blade element comprises at least one radially extending blade that engages an underside of the annular screen and the hollow agitator shaft comprises the least one radially extending blade that engages an upper surface of the annular screen.

14. The canister assembly of claim 13 wherein the lower blade element and the agitator shaft are snap-fitted together.

15. The canister assembly of claim 11 wherein an upper end of the hollow agitator shaft is connected to a deflector cap for enclosing the upper end of the hollow agitator shaft.

16. The canister assembly of claim 15 wherein the deflector cap comprises a lower flange connected to and disposed below a lower cylindrical wall, the lower flange having a maximum outer diameter greater than that of the lower cylindrical wall, the lower cylindrical wall being connected to an upper cylindrical wall by a horizontal step, the upper cylindrical wall being connected to an enclosed by a solid top, the maximum outer diameter of the lower cylindrical wall being greater than that of the upper cylindrical wall, the lower cylindrical wall comprising diametrically opposed openings therein and a pair of diametrically opposed vertical recesses extending from the lower flange to one of the openings, the hollow agitator shaft comprising a pair of diametrically opposed cleats that snap-fit into the openings of the lower cylindrical wall of the deflector cap.

17. The canister assembly of claim 11 further comprising a centralizer mateably received over the hollow agitator shaft, the centralizer comprising an outer ring connected to an inner ring by a plurality of radially extending spokes, the hollow agitator shaft comprising a circumferential rib, the inner ring of the centralizer comprising a horizontal lower flange that engages and is supported by the circumferential rib.

18. The canister assembly of claim 16 further comprising a centralizer mateably received over the hollow agitator shaft, the centralizer comprising an outer ring connected to an inner ring by a plurality of radially extending spokes, the inner ring of the centralizer comprising a pair of diametrically opposed recesses for accommodating the cleats of the agitator shaft and allowing the centralizer to be slid downward on the shaft past the cleats, the hollow agitator shaft comprising a circumferential rib, the inner ring of the centralizer comprising a horizontal lower flange that engages and is supported by the circumferential rib.

19. A canister assembly for storing viscous fluids, the canister assembly comprising:

an annular housing comprising an outer cylindrical wall, a bottom and an inner standpipe, the bottom comprising an outlet connected to a pump, the bottom connecting the outer cylindrical wall to the inner standpipe, an annular screen element that slides over the standpipe, the annular screen element comprising a cylindrical outer shell that slides inside the outer cylindrical wall of the annular housing, the cylindrical outer shell having an upper end and a lower end, the annular screen element further comprising an annular screen disposed horizontally within the vertical cylindrical outer shell and spaced above the lower end thereof, the lower end of the outer cylindrical shell supporting the annular screen element above the bottom of the annular housing and above the outlet, a hollow agitator shaft mateably received over the standpipe and above the annular screen element, a lower blade element mateably received over the standpipe and below the annular screen element, the lower blade element and agitator shaft being snap-fitted together with the annular screen element sandwiched therebetween, the lower blade element comprising at least one radially extending blade that engages an underside of the annular screen and the hollow agitator shaft comprises the least one radially extending blade that engages an upper surface of the annular screen, an upper end of the hollow agitator shaft being snap-fitted to a deflector cap for enclosing the upper end of the hollow agitator shaft, the deflector cap comprising a lower flange connected to and disposed below a solid top, the lower cylindrical wall comprising diametrically opposed openings therein and a pair of diametrically opposed vertical recesses extending from the lower flange to one of the openings, the hollow agitator shaft comprising a pair of diametrically opposed cleats that snap-fit into the openings of the lower cylindrical wall of the deflector cap, a centralizer mateably received over the hollow agitator shaft, the centralizer comprising an outer ring connected to an inner ring by a plurality of radially extending spokes, the hollow agitator shaft comprising a circumferential rib, the inner ring of the centralizer comprising a horizontal lower flange that engages and is supported by the circumferential rib, the inner ring of the centralizer comprising a pair of diametrically opposed recesses for accommodating the cleats of the hollow agitator shaft and allowing the centralizer to be slid downward on the shaft past the cleats.

* * * * *